US005853352A

United States Patent [19]

Login

[11] Patent Number: 5,853,352

[45] Date of Patent: Dec. 29, 1998

[54] REDUCED VERTICAL IMPACT EXERCISE PLATFORM

[75] Inventor: Steven Login, c/o PT Strategies Corporation, 9 Sewall Ave., Brookline, Mass. 02146

[73] Assignee: Steven Login, Brookline, Mass.

[21] Appl. No.: 908,458

[22] Filed: Aug. 7, 1997

[51] Int. Cl.[6] ..... A63B 5/16

[52] U.S. Cl. ..... 482/26; 422/23; 422/77

[58] Field of Search ..... 422/23, 26, 27, 422/77, 54, 51

[56] References Cited

U.S. PATENT DOCUMENTS

| | | | |
|---|---|---|---|
| 3,627,313 | 12/1971 | Schonfeld . | |
| 3,641,601 | 2/1972 | Sieg . | |
| 3,703,284 | 11/1972 | Hesen | 482/54 |
| 4,037,834 | 7/1977 | Oaks . | |
| 4,199,136 | 4/1980 | Mansfield . | |
| 4,253,661 | 3/1981 | Russell . | |
| 5,018,722 | 5/1991 | Whitmore | 482/54 |
| 5,336,144 | 8/1994 | Rodden | 482/54 |
| 5,387,166 | 2/1995 | Gvoich . | |
| 5,472,390 | 12/1995 | Faye . | |
| 5,562,575 | 10/1996 | Gvoich . | |

FOREIGN PATENT DOCUMENTS

| | | |
|---|---|---|
| 53-125174 | 10/1978 | Japan . |

*Primary Examiner*—Lynne A. Reichard
*Attorney, Agent, or Firm*—Pillsbury, Madison & Sutro

[57] ABSTRACT

A reduced vertical impact exercise platform is provided having a frame structure which, at least in part, encloses a platform assembly comprised of a plurality of distinct layers including a durable, resilient outer contact layer; a resilient padding layer; a reinforcing stiffening layer; a plurality of resilient cushioning members and a foundation layer. An optional stretch cord assembly and harness assembly are also provided for use with the exercise platform.

20 Claims, 5 Drawing Sheets

REDUCED VERTICAL IMPACT EXERCISE PLATFORM

FIELD OF THE INVENTION

This invention relates to exercising devices and more particularly to an in-place reduced vertical impact exercise platform.

BACKGROUND OF THE INVENTION

The beneficial effects of strengthening and conditioning exercise such as walking, running, jumping, jogging and other vertical impact exercises are well known. However, each of these exercise techniques can induce impact force stresses on the back and joints of the lower extremities during exercise activities which can, in turn, cause damage to soft tissue and bone. After an athlete has sustained an injury, or individuals who have had surgery or for other reasons require rehabilitative therapy, a regime of strengthening exercise may be necessary as part of a physical rehabilitation program.

The potential for re-injury during such rehabilitative exercise is ever present and every effort should be made to mitigate the effects of impact stress forces normally experienced when undertaking stressful exercises. In addition to the potential for re-injury, the physical rehabilitation training of an injured athlete or accident victim may also be delayed due to the individual's decreased tolerance to forces associated with impact stress as the training progresses through increasingly demanding levels of activity. Further, tendinitis, which can develop during physical rehabilitation therapy, can be a major factor in delaying an individual's return to sports or normal activity. Progress delays in rehabilitation therapy serve to prolong the discomfort associated with an injury, reduce the overall physical stamina of the inactive individual, and may even impact on a competitive advantage normally realized by an active athlete. It is, therefore, essential that every effort be made to assist the individual undergoing rehabilitative exercise therapy to progress through a regimented rehabilitative program without undue delay and with as little discomfort as possible.

In order to decrease the potential for re-injury and assist individuals in avoiding other delays in the rehabilitation effort, it is often desirable to initiate early rehabilitative exercise programs in as controlled an environment as possible. Indoor exercise sessions permit close monitoring of the rehabilitative exercise program and serve to eliminate potential hazards associated with slipping or tripping due to climate or uneven terrain normal to outdoor activities. Further, an in-place exercise program permits continuous monitoring of a training program or of rehabilitative exercise activity in a controlled environment. As part of such rehabilitative exercise, a need exists for an effective reduced vertical impact stress device upon which an injured individual undergoing rehabilitative therapy can carry out a regimented program of plyometric (jumping) exercises while reducing delays due to injury often associated with physical rehabilitation programs.

Various exercise devices directed to running or jogging in place are known. However, none of these devices effectively address the special needs of an injured individual undergoing a supervised regimented physical rehabilitation program.

SUMMARY OF THE INVENTION

It is an object of the present invention to provide a reduced impact exercise platform. Such a platform, which can include a unitary, concentrically arranged frame primarily relies upon a unique combination of a plurality of distinct, parallel disposed layers of varying materials that are collectively configured to provide reduced vertical impact stress during jumping, stepping, running in place or similar aerobic exercises. The plurality of distinct layers of the platform assembly are selected and arranged to provide a stable platform upon which the exercising individual can effectively follow a regimented program of increasingly stressful plyometric exercises with minimized potential for re-injury.

The frame holds the distinct layers of the impact platform together and provides a stable base of sufficient strength and weight to maintain the exercise device in position on a floor surface during use. Optionally, the frame can be provided with multiple anchoring members to which an optional stretch cord assembly can be removably attached. The optional stretch cord assembly can be secured to an individual, for example, by a harness assembly, and is designed to provide increased downward tension during plyometric exercises and to further provide a safety restraint for the individual when using the device.

The distinct layers of the impact platform assembly, which are selected to provide stability and optimal vertical impact reduction, include, for example, from top to bottom: a first, outer contact layer formed of a durable, resilient material; a padding layer formed of an impact absorbing resilient material; then a stiffening layer formed of semi-rigid material; a resilient layer formed of a plurality of resilient cushioning members; and a foundation layer formed of a semi-rigid material.

DETAILED DESCRIPTION OF THE INVENTION

Figure 1:
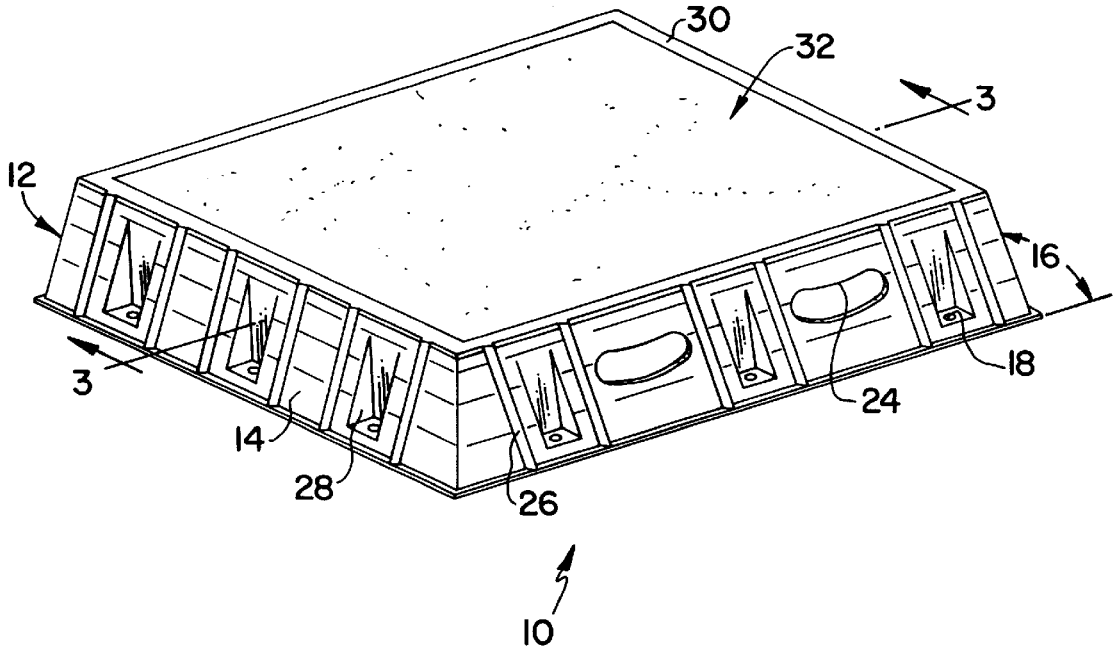
FIG. 1 is a perspective view of a reduced impact exercise platform embodying the principles of the present invention.

While the present invention is open to various modifications and alternative constructions, the preferred exemplary embodiment, as shown in the drawings, will be described in detail.

Figure 2:
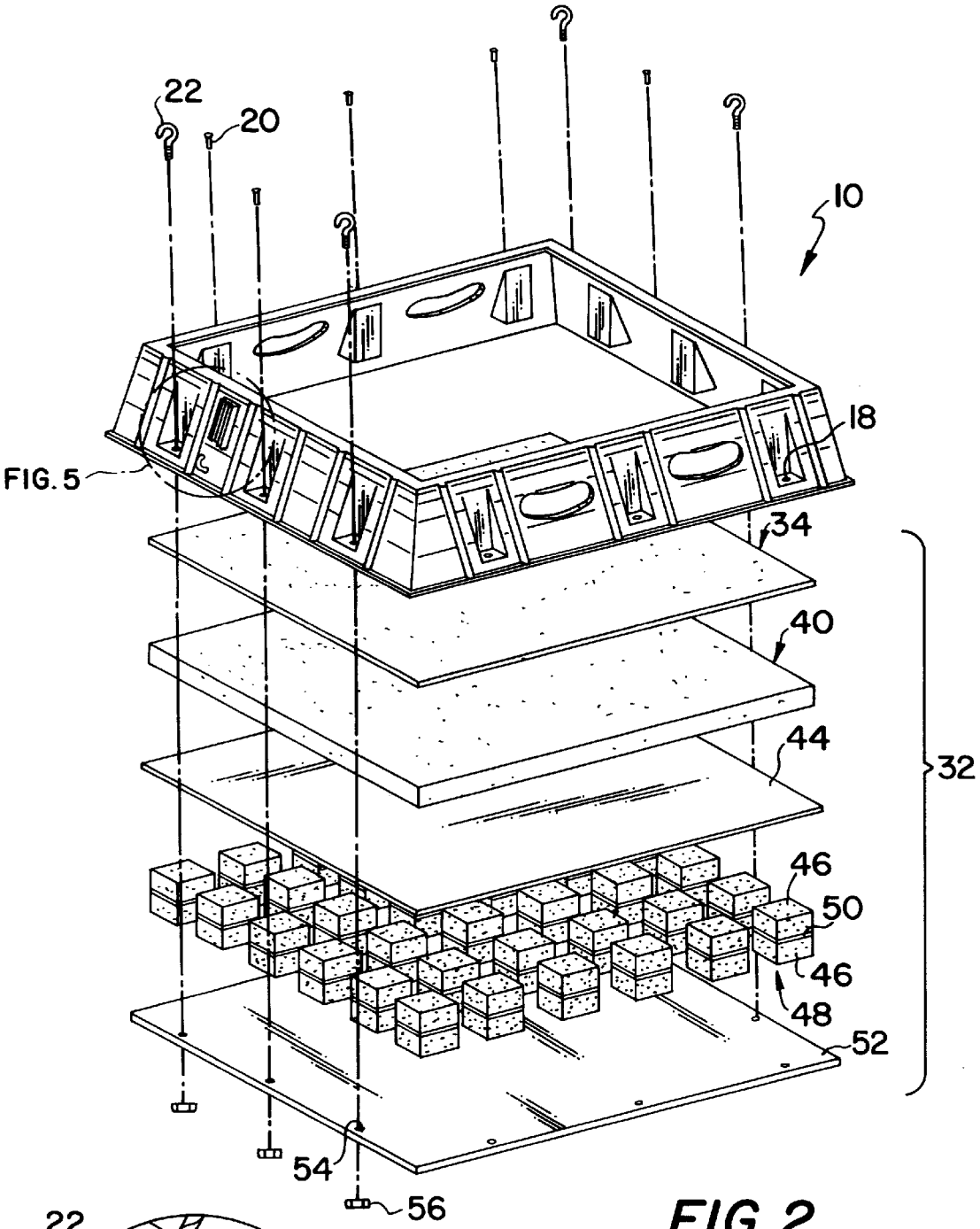
FIG. 2 is an exploded perspective view of the reduced impact exercise platform of FIG. 1.
Figure 3:
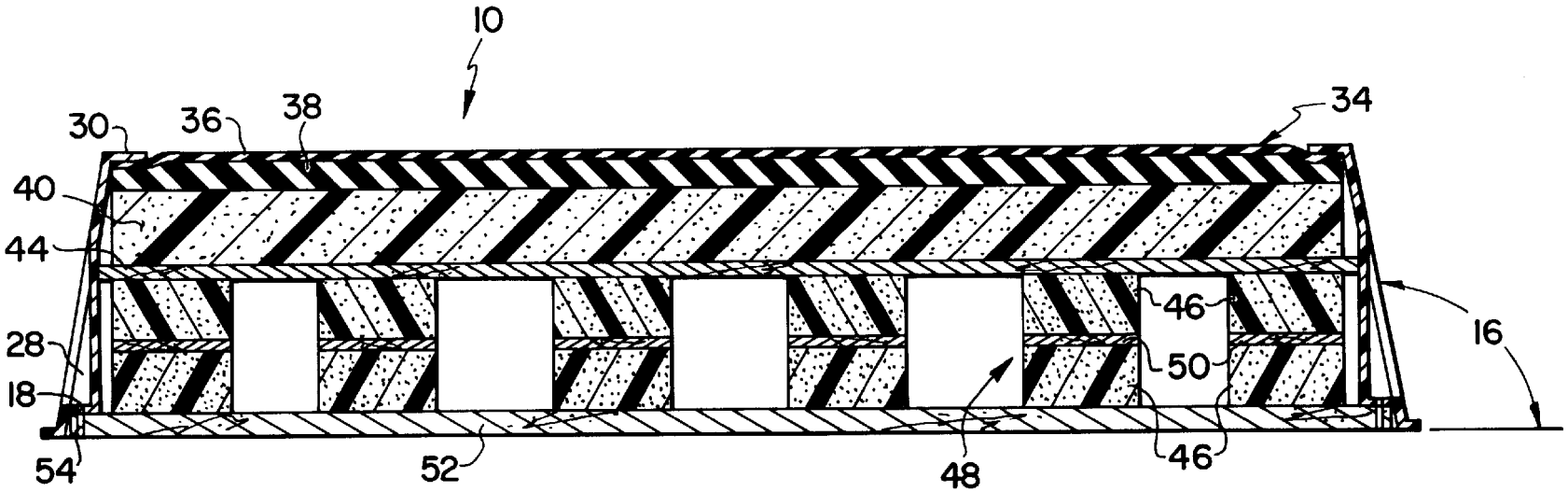
FIG. 3 is sectional view taken along line 3—3 of the reduced impact exercise platform of FIG. 1.

Referring to FIGS. 1–3, a reduced impact exercise platform is generally indicated at 10 and includes a frame structure, generally indicated at 12. The frame structure 12 is shown in the form of a closed, four-sided structure which when placed on a floor or like surface each of the four sides 14 will contact the floor surface. The sides 14 can be straight or alternatively could be at a slightly oblique angle 16 to the floor surface. The lower portions of each of the four sides 14 define a plurality of circumferentially spaced progressively enlarging recesses 18. Alternatively, the sides 14 could be flat or have another shaped design configuration such as, for example, being concave, convex or with a series of progressive undulations. Alternatively, the frame could be discontinuous yet still extend about the structure. It is, however, within the contemplation of the present invention to provide a frame structure formed of distinct sections fixedly secured one to another to form an integral structure.

The frame structure 12 can be produced by any number of methods and materials which would result in the production of a structure configured to hold the interior layers together and provide a strong, impact resistant frame structure. Materials which could be used to fabricate the frame structure include, for example, metal, wood, moldable resins, and the like. Preferred materials for the frame structure are moldable thermosetting and thermoplastic resins, one non-limiting example of which is moldable high density polyethylene.

A plurality of securing members 20, such as screws or bolts, can be used with the openings 18 and a bottom or foundation layer 52 to maintain the structural integrity of a completely assembled exercise platform 10. A plurality of optional anchoring members 22 can be attached to a select number of the openings 18 or in separate openings provided therefor. The securing members 20 or the anchoring members 22 can be configured to be threadably engaged, frictionally engaged or similarly releasably attached to the openings 18.

Gripping surfaces or handle openings 24, may be optionally provided to assist in positioning or moving the exercise platform 10.

Each of the four sides 14 can be configured to have a plurality of spaced apart rib structures 26 which serve to provide structural reinforcement at selected points of the four sides 14.

Each of the four side walls 14 can include a plurality of shaped recess areas 28 that preferably provide a ledge or sill in which openings 18 are located as well as the securing members 20 or the optional anchoring members 22.

An inwardly projecting retaining surface or lip 30 is integrally formed along at least portions of the upper surface of each of the four sides 14. Alternatively, the lip 30 could extend continuously about the device. The retaining surface or lip 30 provides a contact layer for the under-positioned platform assembly, generally indicated at 32.

The platform assembly 32 includes a plurality of distinct layers which collectively serve to evenly distribute the impact stress of the user's exercise activity so as to mitigate the potential for injury or re-injury.

Each of the distinct layers of the platform assembly 32 are described below in descending order.

Figure 4:
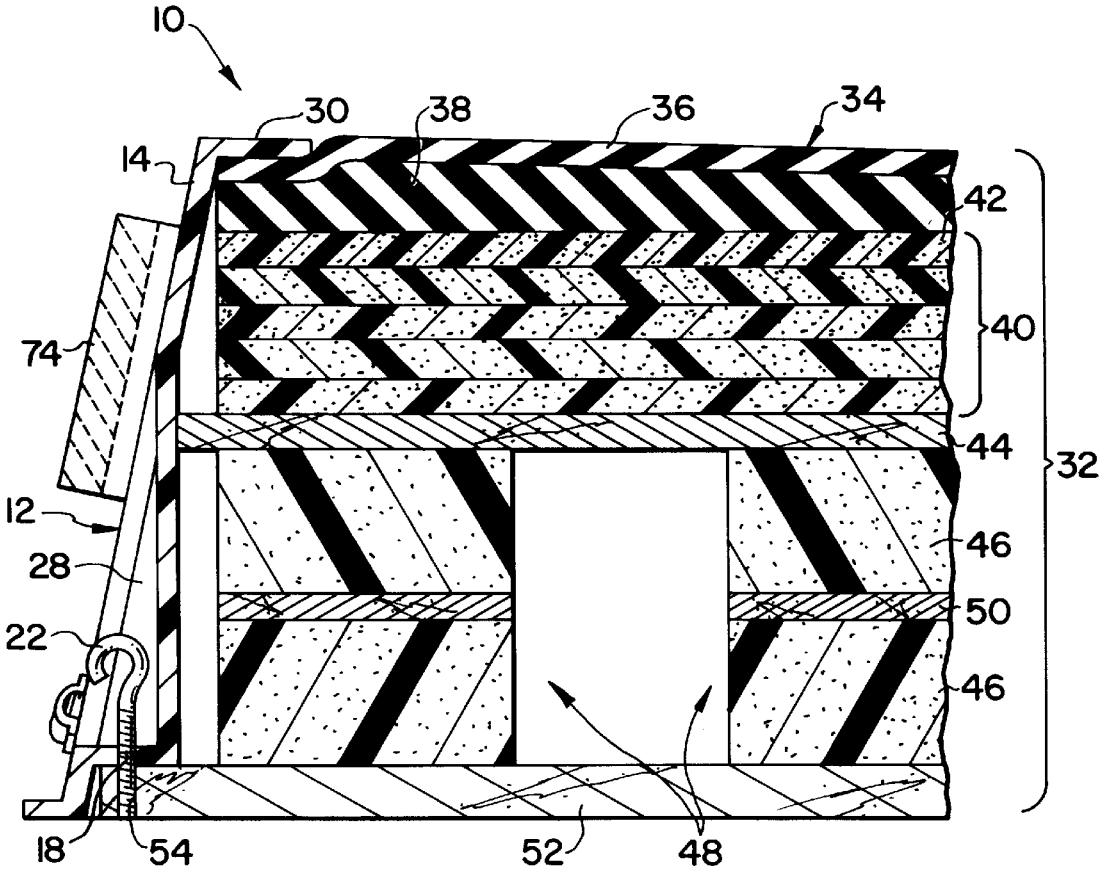
FIG. 4 is a fractional, sectional view of the present invention showing optional anchoring members as attachment points for a stretch cord assembly and an alternative assembly for use as the second padding layer.

A first or outermost layer of the platform assembly 32 is a contact layer, generally indicated at 34. Peripheral portions of the contact layer 34 are circumferentially positioned directly beneath and retained within the frame structure 12 by the retaining surface or lip 30. The outermost layer, contact layer 34, is formed of a durable, non-skid, impact absorbing, resilient material. Non-limiting examples of material which are suitable for use as the contact layer include, for example, rubber-based compositions, plastics, blends thereof and the like. As shown in FIGS. 3–4, a preferred material for contact layer 34 is a fused, bi-layer rubber-based compound having a durable, non-skid, impact absorbent upper portion 36 and an impact absorbent lower portion 38. The upper portion 36 is relatively more dense and has a higher durometer measurement than the impact absorbent lower portion 38. A more preferred contact layer 34 for the present invention is a fused bi-layer rubber-based compound available as Mondo sport flex rubber compound (Athletic Flooring Systems, Del Carmine St. Wakefield, Mass.).

Fusion of the bi-layer rubber-based compound to form the contact layer 34 can be accomplished by a variety of techniques including, for example, gluing, heat sealing, molding, or other known approaches in the art to adhere one compounded rubber-based surface to another surface. As shown in FIGS. 2–4, the contact layer 34 has lateral dimensions which enable it to securely fit beneath the retaining surface or lip 30 of the frame structure 12. The components and thickness of the contact layer 34 are selected to provide a resilient, durable non-skid surface with high impact absorbance. The thickness of the contact layer 34 is preferably about ¼" to about 1½", more preferably about ½" to about 1" and most preferrably about ⅓" to about ¼".

The next layer in the platform assembly 32 is a padding layer, generally indicated at 40. Padding layer 40 is formed of an impact absorbing, resilient material. Examples of materials which can be used to make the padding layer 40 include, for example, foam rubber, foam plastic, or combinations thereof, sponge material and similar open-cell or closed-cell materials that quickly return to their original shape after being compressed. More specific examples of such materials include, for example, natural or synthetic rubber or rubber-based blends, butadiene-styrene, silicon foam, and vinyl foam. A preferred example of the material used to fabricate the padding layer 40 is closed-cell poly foam padding. Closed-cell foam padding is preferred to open-cell foam padding as it provides faster rebound to the original shape after being compressed. As shown in FIG. 4, a more preferred padding layer 40 is a multi-layer closed-cell poly foam padding assembly formed by fusing a plurality of individual closed-cell poly foam pads 42. Most preferred is a padding layer 40 formed from about 2 to about 7 individual closed-cell poly foam pads 42. The preferred embodiment shown in FIG. 4 includes a fused padding layer 48 including 5 closed-cell poly foam pads 42. Fusing of the individual closed-cell poly foam pads 42 to form the padding layer 40 can be accomplished by use of any adhesive processes known in the art for adhering adjacent poly foam surfaces together to include, for example, gluing, heat sealing, use of mechanical attachments, or the like. The preferred process used to fuse the individual closed-cell poly foam pads 42 to form a fused padding layer 48 is gluing. The entire surface of each individual closed-cell poly foam pad 42 can be treated with adhesive prior to fusing or a spot-gluing process can be used. The spot-gluing process can be applied along the periphery of each of the individual closed-cell poly foam pads 42 or the spot-gluing process can be applied in a pattern across the surface of each of the pads 42. Preferably, the entire surface of the pads 42 will be treated with the adhesive in the fusing process in order to provide an integral padding layer 40 which responds as a single unit to applied compression forces. The padding layer 40 is of substantially the same lateral dimensions as the overlying contact layer 34. The thickness of the padding layer 40 preferably ranges between about ¾" to about 3½", more preferably between about 1" to about 3" and most preferably about 1½" to about 2½".

Beneath padding layer 40 in the platform assembly 32 is a stiffening layer 44 that provides a stabilizing function for the first two, upper two layers 34, 40 of the platform assembly 32. As a user performs plyometric type exercises on the exercise platform 10, the impact force imparted by the user to the contact layer is transmitted substantially evenly to the lower disposed layers of the platform assembly 32. By distributing the impact force in a substantially even manner to the lower disposed layers of the platform assembly 32, the stiffening layer 44 provides stability to the assembly 32, thereby improving the overall cushioning effect and safety of the assembly 32 for the user. The stiffening layer 44 is preferably formed of a sheet from a material exhibiting sufficient strength to provide a first stable foundation beneath the outermost layer 34 and the next inner padding layer 40. Examples of materials suitable for use as stiffening layer 44 include, for example, wood, plywood, masonite, plastic, metal, combinations thereof or the like. A preferred material for use as the stiffening layer is a plywood sheet having about a ½" to 1" thickness; and more preferably plywood of ¾" thickness; and most preferably OSB plywood of ¾" thickness which is commercially available from NE Die Cutting/PDF, 449 River Street, Haverhill, Mass. 01832.

The next layer positioned beneath the first stiffening layer 44 in the platform assembly 32 comprises a layer including a plurality of spaced apart resilient cushioning members 46. The cushioning members 46 are individually positioned beneath and fixedly secured, as by glue including a hot melt glue to the bottom of stiffening layer 44. A sufficient size and number of the cushioning members 46 are provided beneath stiffening layer 44 to absorb downwardly directed impacts transmitted from and through the upper layers of the platform assembly 32 through the stiffening layer 44. The cushioning members 46 can be formed of any resilient material and preferably comprise open or closed-cell poly foam blocks. More preferably, the cushioning members 46 are formed of closed-cell poly foam blocks each having a substantially square cross-section, with the blocks being 2–5" squares and 3–6" high. Closed-cell poly foam blocks are preferred to open-cell poly foam blocks as they provide faster rebound to the original shape after being compressed. As shown in FIGS. 2–4, the cushioning members 46 are arranged in a spaced apart manner beneath the stiffening layer 44 thereby defining open spaces between adjacent cushioning members 46. Also, as shown in FIGS. 2–4, the arrangement of the individual cushioning members 46 in relation to each other is substantially uniform, thus providing a well balanced absorbance of vertical impact forces transmitted from the above disposed layers of the platform assembly 32.

A preferred embodiment of the present invention, as shown in FIGS. 2–4, includes cushioning members 46 which are configured as a tri-layer cushion assembly, generally shown at 48. The tri-layer cushion assembly 48 includes three distinct layers, two being cushioning members 46 that are separated by a horizontally disposed cushion stabilizer 50 that collectively comprise a second stabilizing layer. The cushion stabilizer 50, as the central element of the cushioning assembly, imparts additional stability and uniformity of impact absorption to the platform assembly 32. The cushion stabilizers 50 can be formed of similar materials to the stiffening layer 44, but preferably are plywood squares of about ¼" to about ½" in thickness. It is within the contemplation of the invention to fabricate the cushioning members 46 with one or more additional spaced apart cushion stabilizers 50 for the cushion assembly 48 as a means to increase the general stability of the platform assembly 32. When employed, additional cushion stabilizers 50 in the cushion assembly 48 are spaced apart by a corresponding number of additional cushion members 46.

A foundation or bottom layer in the platform assembly 32 is a foundation layer 52 which provides foundational support to the upper four layers of the platform assembly 32 and acts as a base for contacting the floor surface upon which the exercise platform 10 is placed during use. The foundation layer 52 is provided with a plurality of receiving openings 54, the size and alignment of which correspond to the openings 18 of the frame structure 12. When the exercise platform 12 is fully assembled, the securing members 20, or optionally the anchoring members 22, pass downwardly through openings 18 of the frame structure 12 and through the receiving openings 54 of the foundation layer 52. The securing members 20, or optionally the anchoring members 22, are securely fastened into the receiving openings 54 or optionally can be securely fastened directly beneath the foundation layer 52 by receiving members 56. A secure connection of the securing members 20, or optionally the anchoring members 22, with the receiving openings 54, or optionally the receiving members 56, can be accomplished by a variety of methods to include but not limited to threaded connections, frictional connections, pin and cotter-key connections, adhesive connections or any other method known in the art for providing a structurally sound connection. Threaded connections, such as for example, bolts, are preferred. The foundation layer 52 can be formed of similar materials to the stiffening layer 44 and is preferably formed of ¾" plywood. Most preferably, the foundation layer 52 is formed of ¾" CDX plywood which is commercially available from NE Die Cutting/PDF, 449 River Street, Haverhill, Mass. 01832.

Figure 5:
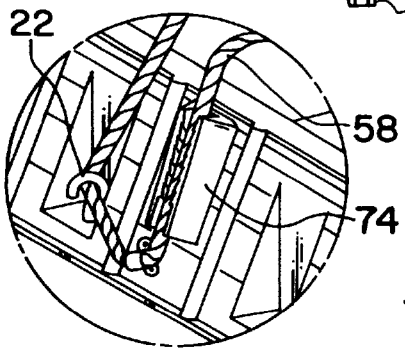
FIG. 5 a perspective view of an optional anchoring member engaged with a portion of an optional stretch cord assembly.
Figure 6:
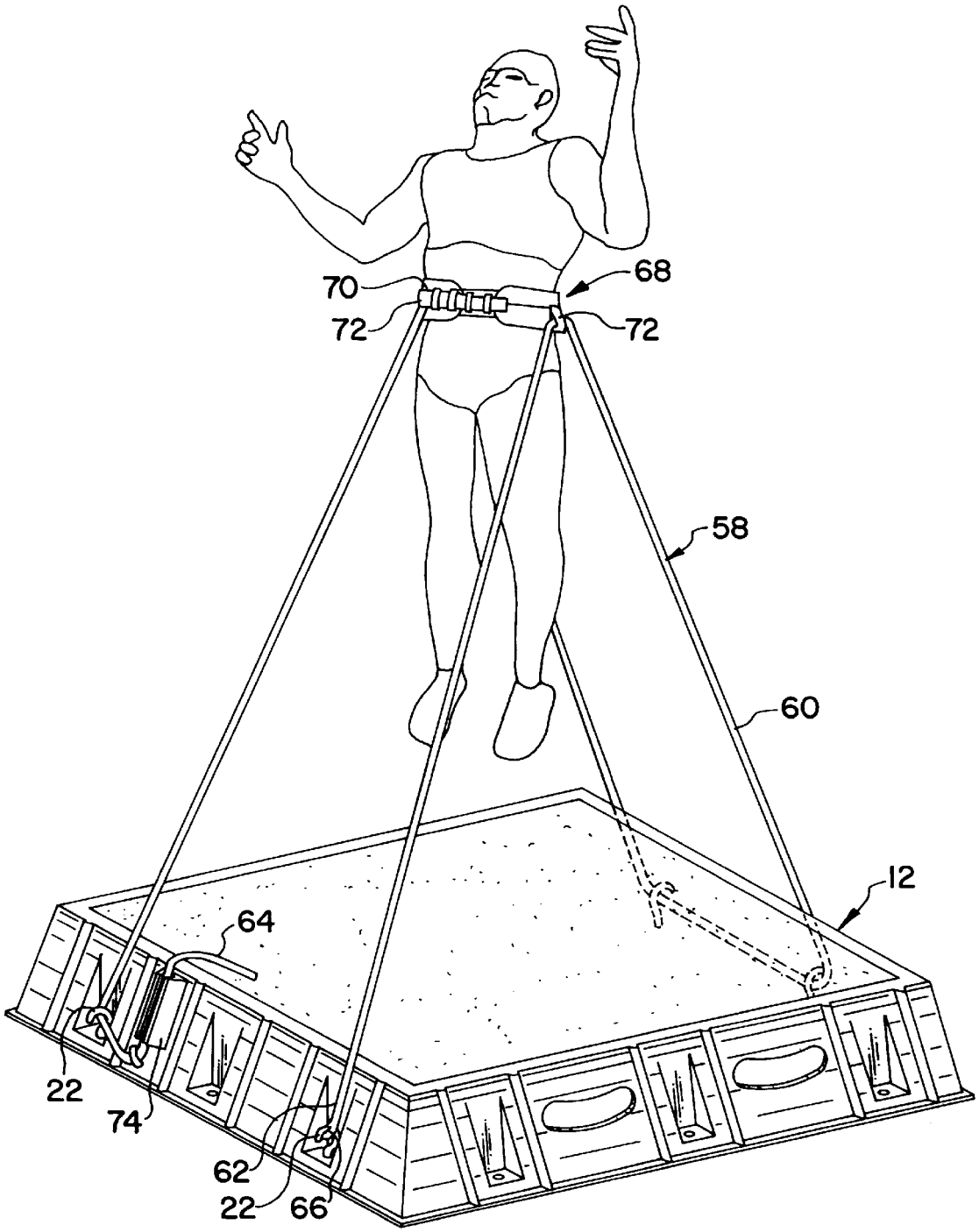
FIG. 6 is an elevated perspective view of the reduced impact exercise platform of FIG. 1 configured with an optional stretch cord assembly and associated user harness assembly.

The exercise platform 10 can be provided with an optional stretch cord assembly, generally indicated at 58 in FIGS. 5 and 6. The stretch cord assembly 58 includes a stretch cord 60 having a first end 62 and a second end 64. The first end 62 terminates in a closed loop 66.

When employing the stretch cord assembly 58, the user wears a harness assembly, generally indicated at 68. The harness assembly 68, includes a harness support 70 and a plurality of stretch cord receivers 72 spaced apart on the harness support 70. At least one stretch cord assembly 58 will be used with the one harness assembly 68 being worn by the user during exercises on the exercise platform 10.

As best shown in FIG. 6, when the stretch cord assembly 58 is used with the exercise platform 10, the closed loop 66 of the first end 62 of the stretch cord assembly 58 is removably attached to one of the anchoring members 22. The second end 64 of the stretch cord assembly 58 is then threaded sequentially through 1) one of the stretch cord receivers 72 on the user's harness support 70, then 2) through another of the anchoring members 22 located on a side of the frame structure 12 opposite the anchoring member 22 attached to the closed loop 66, then 3) through an adjacently located anchoring member 22, then 4) back through a stretch cord receiver 72 located on a side of the user's harness support 70 opposite to the stretch cord receiver 72 which is already engaged with the stretch cord assembly, and finally 5) through an anchoring member 22 adjacently located to the anchoring member 22 to which the closed loop 66 was removably attached.

After the stretch cord assembly 58 has been drawn by the user to a degree of tension the user selects the second end 64 of the stretch cord assembly 58 is passed through and removably secured to a cord grip member 74 mounted on the frame structure 12 proximate to an anchoring member 22. The cord grip member 74 serves to securely hold the stretch cord assembly 58 at the selected degree of tension and is configured to permit easy one-step adjustment of the tension of the stretch cord assembly 58.

When in use, the stretch cord assembly 58 with the harness assembly 68 provides the user with a resistance tension to upward motion thus multiplying the effectiveness of each exercise period. The stretch cord assembly 58 additionally provides a stabilizing influence on the user's balance and thus serves to decrease the possibility of re-injury during plyometric exercises.

It is understood there is no intention to limit the invention to the particular form disclosed. On the contrary, it is intended that the invention cover all modifications, equivalents and alternative constructions falling within the spirit and scope of the present invention, as defined in the appended claims.

What is claimed is:

1. A reduced vertical impact exercise platform comprising:

a platform assembly comprising a plurality of distinct layers including in descending order, an outer contact layer;

a padding layer in at least partial direct contact with said outer contact layer;

a stiffening layer;

a resilient layer comprising a plurality of independent cushioning members;

a foundation layer; and a frame structure providing structural integrity for said platform assembly.

2. The reduced vertical impact exercise platform of claim 1 wherein said frame structure is of unitary construction.

3. The reduced vertical impact exercise platform of claim 1 wherein said frame structure is made of a plastic material.

4. The reduced vertical impact exercise platform of claim 1 wherein said contact layer is made of a durable, resilient material.

5. The reduced vertical impact exercise platform of claim 4 wherein said resilient material is a rubber-based compound.

6. The reduced vertical impact exercise platform of claim 1 wherein said contact layer further comprises a fused, bi-layer rubber compound.

7. The reduced vertical impact exercise platform of claim 1 wherein said padding layer is a foam layer.

8. The reduced vertical impact exercise platform of claim 1 wherein said padding layer comprises a plurality of foam layers fused together.

9. The reduced vertical impact exercise platform of claim 1 wherein said stiffening layer comprises a solid sheet.

10. The reduced vertical impact exercise platform of claim 1 wherein said plurality of independent cushioning members further comprises a plurality of spaced apart members.

11. The reduced vertical impact exercise platform of claim 1 wherein each of said cushioning members is a multi-layer structure.

12. The reduced vertical impact exercise platform of claim 1 wherein said multi-layer structure includes tri-layer cushion members comprising an upper foam cushioning member, at least one middle cushion stabilizer and a lower foam cushioning member.

13. The reduced vertical impact exercise platform of claim 12 wherein said at least one stabilizer comprises a plurality of spaced apart stabilizers.

14. The reduced vertical impact exercise platform of claim 1 wherein said foundation layer comprises a solid sheet.

15. The reduced vertical impact exercise platform of claim 1 wherein said frame structure further comprises an inwardly projecting peripheral retaining surface extending about at least a portion of said frame structure beneath which said platform assembly is retained.

16. The reduced vertical impact exercise platform of claim 1 wherein said frame structure further comprises four sides, said sides being oriented at a generally right angle to a floor surface upon which said exercise platform is placed during use.

17. The reduced vertical impact exercise platform of claim 1 wherein said frame structure further comprises four sides, said sides being oriented at an oblique angle to a floor surface upon which said exercise platform is placed during use.

18. The reduced vertical impact exercise platform of claim 15, wherein said sides define a plurality of spaced apart recesses, each of said recesses defining one of a plurality of side openings, said side openings being of substantially the same size and alignment as a plurality of corresponding receiving openings defined in said foundation layer, each of said side openings and said receiving openings being sized and aligned to receive one of a plurality of securing members, said securing members being removably secured to said receiving openings.

19. The reduced vertical impact exercise platform of claim 16, wherein at least four of said side openings are adapted to receive one of at least four anchoring members.

20. The reduced vertical impact exercise platform of claim 17, wherein each of said anchoring members are configured to receive at least one of a plurality of stretch cords, said stretch cords being adapted and sized to reach from said anchoring members to a harness assembly, said harness assembly being sized and configured to be securely worn by a user of said exercise platform.

* * * * *